US005605743A

United States Patent [19]

Reither

[11] Patent Number: 5,605,743

[45] Date of Patent: Feb. 25, 1997

[54] PAPERMAKER'S FABRIC OF POLYPHTHALAMIDE MONOFILAMENT

[75] Inventor: John R. Reither, Summerville, S.C.

[73] Assignee: Asten, Inc., Charleston, S.C.

[21] Appl. No.: 540,315

[22] Filed: Oct. 6, 1995

Related U.S. Application Data

[63] Continuation of Ser. No. 204,527, Mar. 1, 1994, abandoned.

[51] Int. Cl.[6] ..... D03D 15/00; D03D 15/12; D21F 3/02; F16G 1/04

[52] U.S. Cl. ..... 442/414; 139/420 A; 162/358.2; 162/900; 198/957; 428/902; 474/266

[58] Field of Search ..... 139/420 A; 162/358.2, 162/900; 198/957; 428/229, 902; 474/266

[56] References Cited

U.S. PATENT DOCUMENTS

| | | | |
|---|---|---|---|
| 4,218,509 | 8/1980 | Edgar et al. | 528/339 |
| 4,238,603 | 12/1980 | Chapman et al. | 528/339 |
| 4,603,166 | 7/1986 | Poppe et al. | 524/606 |
| 5,094,719 | 3/1992 | Fry | 162/358 |
| 5,244,543 | 9/1993 | Fry | 162/358.2 |

FOREIGN PATENT DOCUMENTS

| | | | |
|---|---|---|---|
| 0291096 | 11/1988 | European Pat. Off. | C08K 7/04 |

OTHER PUBLICATIONS

Ultra–High Performance Marks A Brand–New Resin, Modern Plastics, Feb. 1991, pp. 24–25.

*Primary Examiner*—James C. Cannon
*Attorney, Agent, or Firm*—Volpe & Koenig, P.C.

[57] ABSTRACT

A industrial fabric of monofilament of polyphthalamide having recurring units including copolymerized hexamethylene diamine and mixtures of copolymerized terephthalic acid, isophthalic acid, and adipic acid. The monofilament has excellent hydrolysis, chemical, and abrasion resistance. It is particularly useful for the cloth in the forming and pressing sections of a papermaking machine.

6 Claims, 4 Drawing Sheets

PAPERMAKER'S FABRIC OF POLYPHTHALAMIDE MONOFILAMENT

This application is a continuation of application Ser. No. 08/204,527, filed Mar. 1, 1994, now abandoned.

FIELD OF THE INVENTION

The present invention relates generally to industrial fabrics and more particularly to papermaking fabric which must exhibit excellent hydrolysis, chemical, and abrasion resistance.

BACKGROUND OF THE INVENTION

Generally, in the process for making paper, incremental amounts of liquid are removed from a slurry of pulp in a succession of steps. In a first forming step, the slurry is deposited on a porous fabric which drains much of the liquid by gravity and suction, and leaves a wet web of solids on the fabric surface. In a later pressing step, the wet web is compressed between fabrics to remove additional liquid. In a still later, drying step more liquid is removed by evaporation, usually by supporting the web by dryer fabrics so that the web is in contact with large diameter, smooth, heated rolls.

The papermaking process places considerable demands on the fabrics used in each process step. The fabrics should be structurally strong, flexible, abrasion resistant, chemical resistant and able to withstand the high temperatures to which they can be exposed for extended times.

One major improvement in the technology of papermaking fabric has been the introduction of synthetic polymer monofilament. A suitable polymer must provide a yarn having physical properties which satisfy the requirements of automated fabric manufacturing and the demands of papermaking.

Monofilaments have been made from such polymers as polyethylene terephthalate (PET) and polyphenylene sulfide (PPS). The physical properties of a monofilament affect its suitability for use in a papermaking fabric. PET has good dimensional stability, reasonable resistance to abrasion and is moderately priced; however, it has marginal hydrolytic stability and it degrades rapidly in the presence of a caustic solution. PPS monofilament has excellent hydrolytic and thermal stability but is very expensive and relatively brittle.

It is desired to provide a papermaker's fabric having improved caustic, hydrolysis and abrasion resistance.

SUMMARY OF THE INVENTION

The present invention provides a papermaker's fabric comprising a polyphthalamide monofilament consisting essentially of:

(A) about 65 to about 90 mole % of recurring units according to the formula

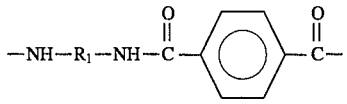

(B) about 0 to about 25 mole % of recurring units according to the formula

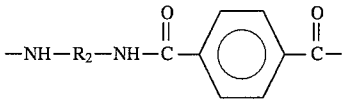

and, (C) about 5 to about 35 mole % of recurring units according to the formula $$-NH-R_3-NH-\overset{O}{\overset{\|}{C}}-(CH_2)_4-\overset{O}{\overset{\|}{C}}-;$$

wherein the sum of (A) -(C)[1] totals to 100 mole %; each of $R_1$, $R_2$ and $R_3$ is independently a divalent aliphatic hydrocarbyl radical of 4–12 carbon atoms; and further provided, that the mole ratio of the dicarboxylic acid moieties in the units (B) :(C) is less than 3:1.

There is also provided a process for making papermaker's fabric using polyphthalamide monofilament.

DETAILED DESCRIPTION OF THE PREFERRED EMBODIMENTS

Figure 1:
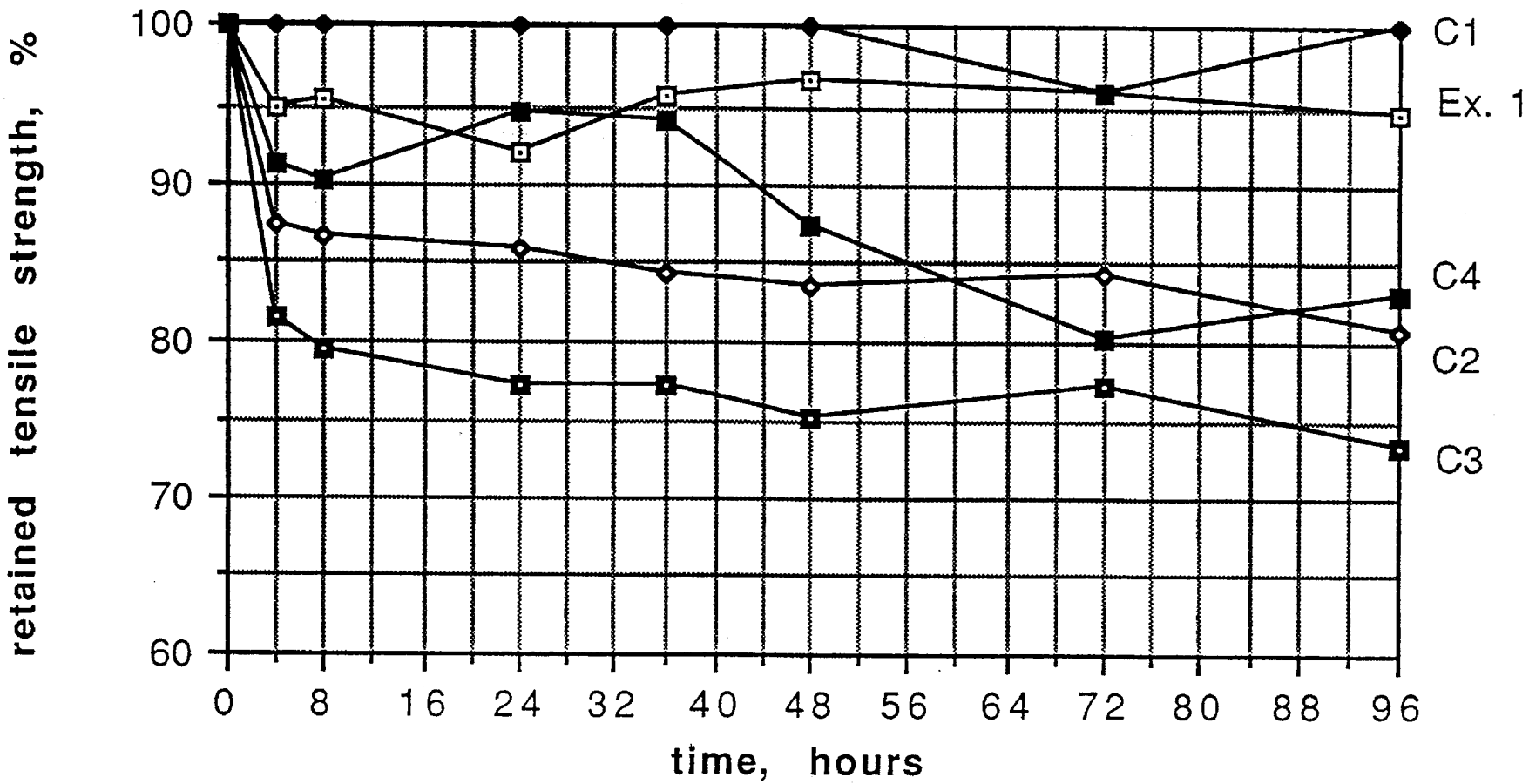
FIG. 1 is a graph of percent retained tensile strength of selected polymer monofilaments plotted against duration of exposure to caustic solution at 85° C.

The monofilament according to this invention was made from a base resin of crystalline polyphthalamide which is more fully described in U.S. Pat. No. 4,603,166 and that description is incorporated herein by reference. A preferred polyphthalamide includes recurring units consisting essentially of copolymerized hexamethylene diamine (HMDA), copolymerized terephthalic acid (TPA), copolymerized isophthalic acid (IPA), and copolymerized adipic acid (AA). Particularly preferred polyphthalamides are terpolyamides of copolymerized HMDA/TPA, HMDA/IPA and HMDA/AA which are available from Amoco Corporation under the Amodel® tradename.

Monofilaments according to the present invention were prepared using conventional extrusion and filament spinning equipment. Suitable polyphthalamide resin is typically supplied as particles in granular or pellet form. The particles should have a low moisture content, e.g., less than about 0.07 wt %, to avoid water vapor evolution during subsequent extrusion which causes the extrudate to break. Preferably, the polyphthalamide is melt processible in the temperature range of about 575° F. to about 640° F., and more preferably at about 630° F. Prolonged exposure to temperatures in this range causes the polyphthalamide to degrade. Consequently, care should be taken to minimize degradation by reducing the polyphthalamide residence time in the extruder and by eliminating regions in the extruder that are heated above the preferred temperature range. Techniques for minimizing degradation are well known and include, among others, widening the clearance of any barrier flight mixing head used on the extruder screw and eliminating dead spots and unnecessarily large cavities in the extruder die and screen pack.

Typically, the melt is filtered through a screen pack, extruded through a multihole die and quenched to produce strands that are drawn and heat-set to form monofilaments. The drawing and heat-setting includes multiple cycles at different draw ratios and temperatures and often includes one or more relaxation steps.

Circular cross-section monofilament for papermaker's fabric typically has a diameter in the range of about 0.1 to 1.5 mm. To obtain the typically desired monofilament dimensions, die holes with larger cross section dimensions than are typical for making comparable filament from polyester or other polyamides should be used. Monofilament of other than circular cross-section, such as flat yarn, can also be produced.

The monofilament of the present invention can be made into industrial fabric by conventional methods. It can be woven on looms into a traditional warp and fill fabric or formed into a spiral fabric in which parallel spiral monofilaments are interlaced with pintle yarns. The fabric of this invention can be formed exclusively from the disclosed monofilament or from the disclosed monofilament in combination with other known materials.

Preferred uses for the fabric of this invention are in the forming and pressing steps of papermaking where exposure to caustic, water and abrasive wear is severe. The fabric should also find utility in dryer applications.

In the discussion that follows, tensile strength and related properties were measured on a tensile testing machine operated with a 10 inch/minute jaw separation rate. Breaking strength is the tensile force required to break a single filament. Knot strength is the tensile force necessary to break an overhand-knotted filament. For the loop strength measurement, interlocking loops were formed with two monofilaments and the ends of each monofilament were clamped in a respective jaw of a tensile testing machine. Loop strength is measured as force necessary to break the interlocked loops. Modulus was measured as the slope of the stress/strain curve at 1 percent strain.

Free shrink was measured as percent dimensional change after unrestrained exposure to 400° F. for 15 minutes. Accelerated hydrolysis resistance was measured as percent of initial tensile strength at break retained by the sample after 5 hours of exposure to steam at 325° F.

Abrasion testing was performed at room temperature and ambient humidity by suspending a 500 g weight from the end of a sample filament draped in an arc contacting with the surface of a revolving "squirrel cage" cylinder. The surface of the "squirrel cage" is comprised of approximately thirty-six evenly spaced 24 gauge, stainless steel wires. Abrasion resistance represents the number of revolutions at a constant rotation speed that caused the sample filament to break.

Monofilaments in accordance with this invention have excellent hydrolyric stability and abrasion resistance. For example, a polyphthalamide monofilament according to the invention lost only 7% of tenacity after 18 days of exposure to steam at 250° F. Also, the polyphthalamide monofilament abrasion performance was about 8,000 cycles to break, which was approximately twice the cycle counts for PET monofilament. The polyphthalamide monofilament according to this invention also exhibits excellent resistance to corrosive chemicals. For example, the retained tensile strength of a polyphthalamide monofilament was 95% after 96 hours of exposure to a sodium hydroxide solution at 100° C.

The present invention will be more fully understood by reference to the following representative examples of certain preferred embodiments thereof, where all parts, proportions and percentages are by weight unless otherwise indicated.

EXAMPLES

Examples 1 and 2 and Comparative Examples C1–C5

A single screw extruder with a Maddock type barrier screw mixing section and 0.025 inch barrier flight wall clearance was used to extrude and form polyphthalamide Amodel® A-1002 resin into a 0.5 mm diameter monofilament. A 2.8 mm diameter spinneret hole was used to obtain stable spinning operation. Use of the large diameter hole did not adversely affect monofilament properties, which are shown in Table 1. A draw ratio of only 4.0:1 was needed to obtain a tenacity of 4.26 grams/denier. To obtain a similar tenacity in a polyester monofilament of the same size requires draw ratios higher than about 5.25:1.

The suitability of the disclosed polyphthalamide monofilament for papermaker's fabric was demonstrated by good knot and loop strength results. Retained knot strength, expressed as a percentage of knot strength to breaking strength, was 55%. This is comparable to polyester resin monofilament which has an expected knot strength of about 60%. However, the coefficient of variation (COV) of retained knot strength for the disclosed monofilament, calculated as the standard deviation of ten measurements divided by the average, was about 5.8%. This very small COV indicates that retained knot strength of a given polyphthalamide monofilament is highly consistent. By comparison, an acid-modified poly(cyclohexane-1,4-dimethylene terephthalate) copolyester had a COV of 30%. Additionally, at 7945 cycles, abrasion resistance was about double the 4000 cycles expected from a polyester monofilament.

Caustic resistance of the polyphthalamide monofilament was tested by the following procedure. Monofilament breaking strength was determined. Samples were treated by immersion in 2.0 N aqueous sodium hydroxide solutions at 85° C. or 100° C. At 4, 8, 24, 36, 48, 72, and 96 hours, samples were removed from each solution and allowed to dry at 72° F. for 24 hours. Breaking strengths of the treated samples were measured and the retained tensile strengths were calculated as percent of initial breaking strength. The caustic resistance test procedure was repeated using each of the following polymer monofilaments:

| Comparative Sample | Monofilament diameter (mm) | Polymer |
|---|---|---|
| C1 | 0.7 | nylon 66 |
| C2 | 0.5 | poly[caproamide-co-(hexamethylene terepthalamide)] |
| C3 | 0.6 | poly[caproamide-co-(hexamethylene terepthalamide)] |
| C4 | 0.5 | poly(metaxylylene adipamide) |

Caustic resistance test results are plotted in FIGS. 1–4, which show that polyphthalamide monofilament according to this invention is more resistant than the other commercial polyamides. FIG. 1 is a plot of retained tensile strengths of monofilaments of Example 1 and Comparative Samples C1–C4 exposed to the caustic solution at 85° C. Although retained tensile strength of polyphthalamide monofilament initially dropped 5%, it remained close to that of nylon 66 for the duration of the test. Retained tensile strengths of Comparative Samples C2–C4 dropped rapidly to less than 85% by 72 exposure hours.

Figure 2:
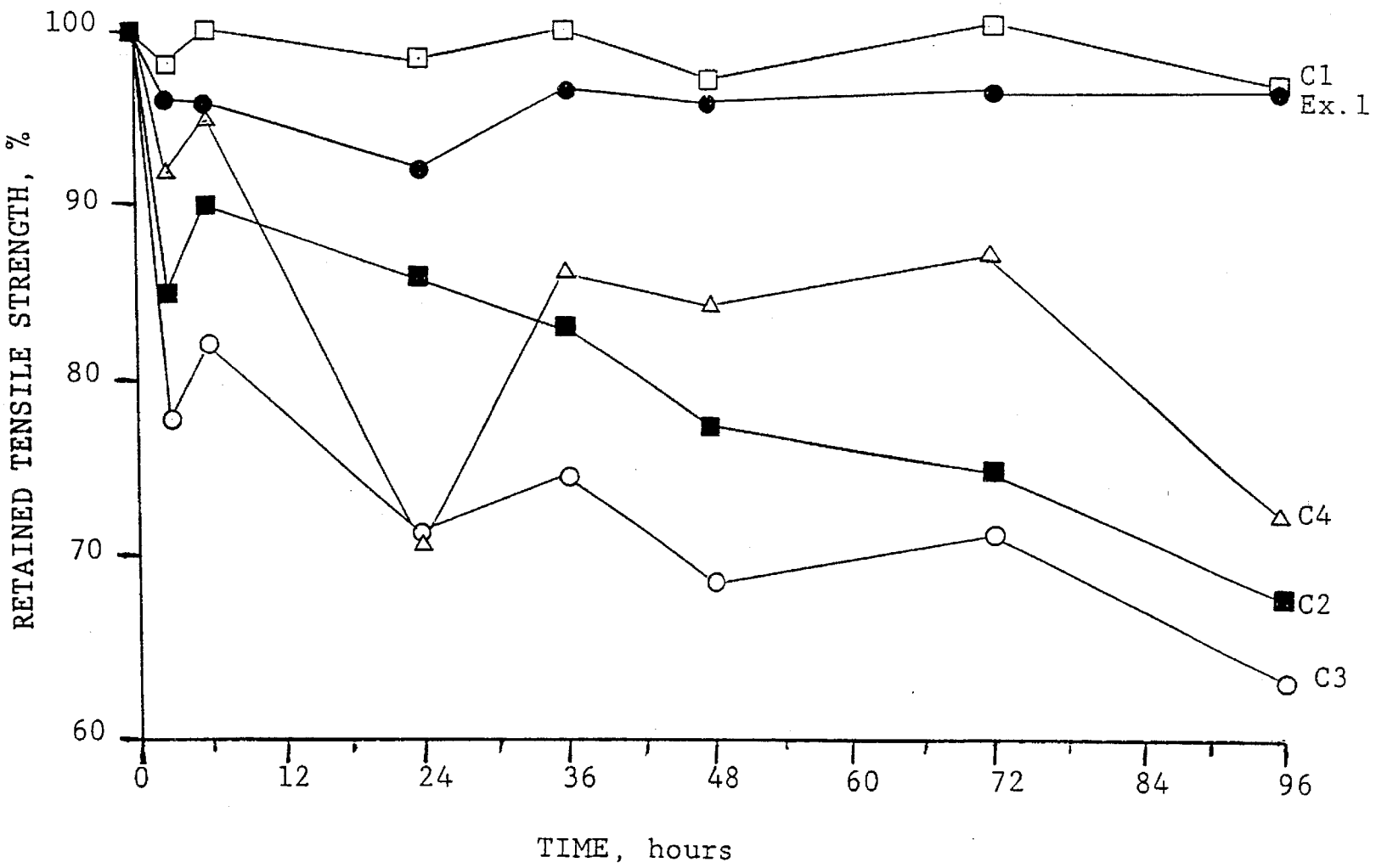
FIG. 2 is a graph of percent retained tensile strength of selected polymer monofilaments plotted against duration of exposure to caustic solution at 100° C.
Figure 3:
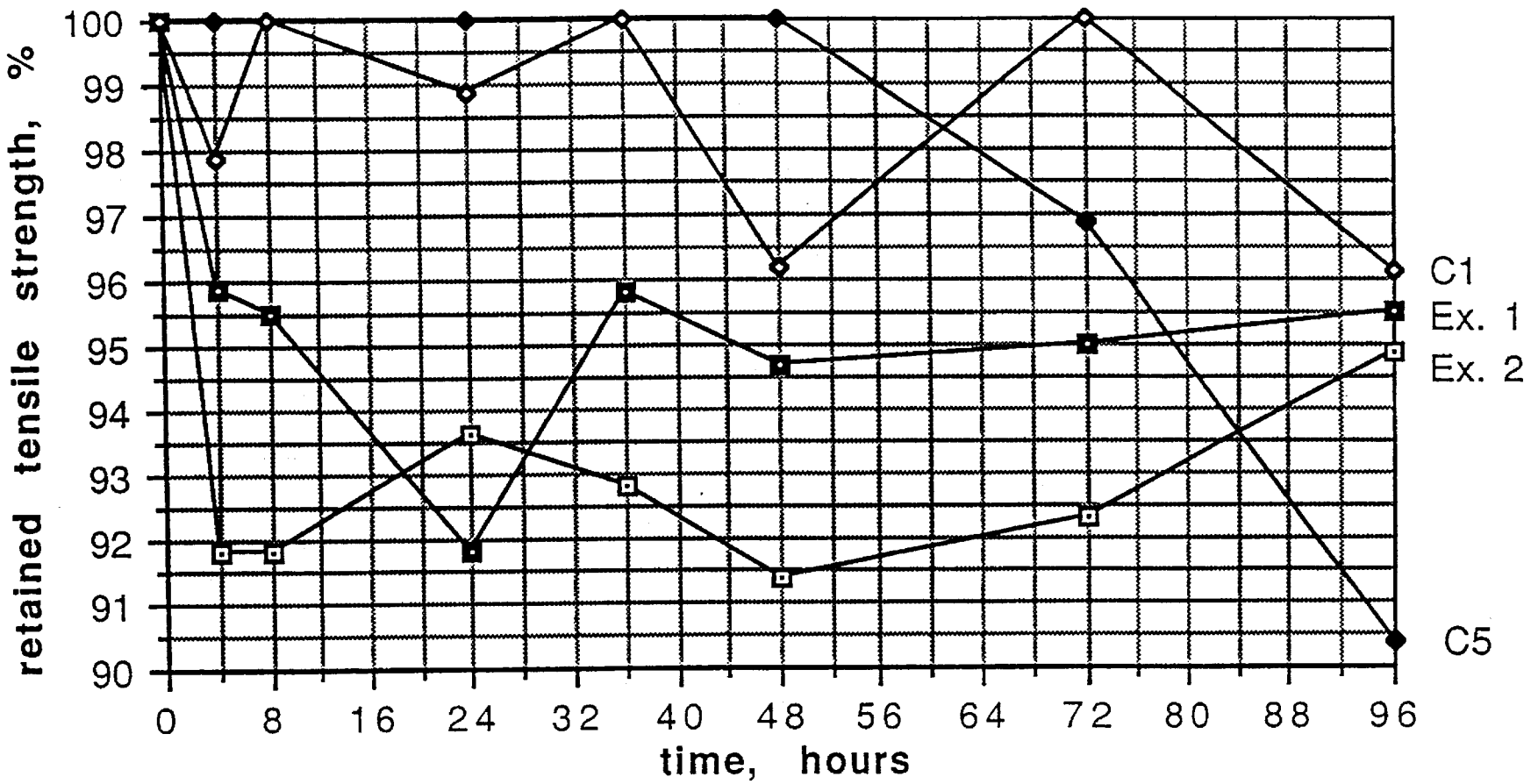
FIG. 3 is a graph of percent retained tensile strength of polyphthalamide monofilament and of nylon 66 monofilament plotted against duration of exposure to caustic solution at 100° C.
Figure 4:
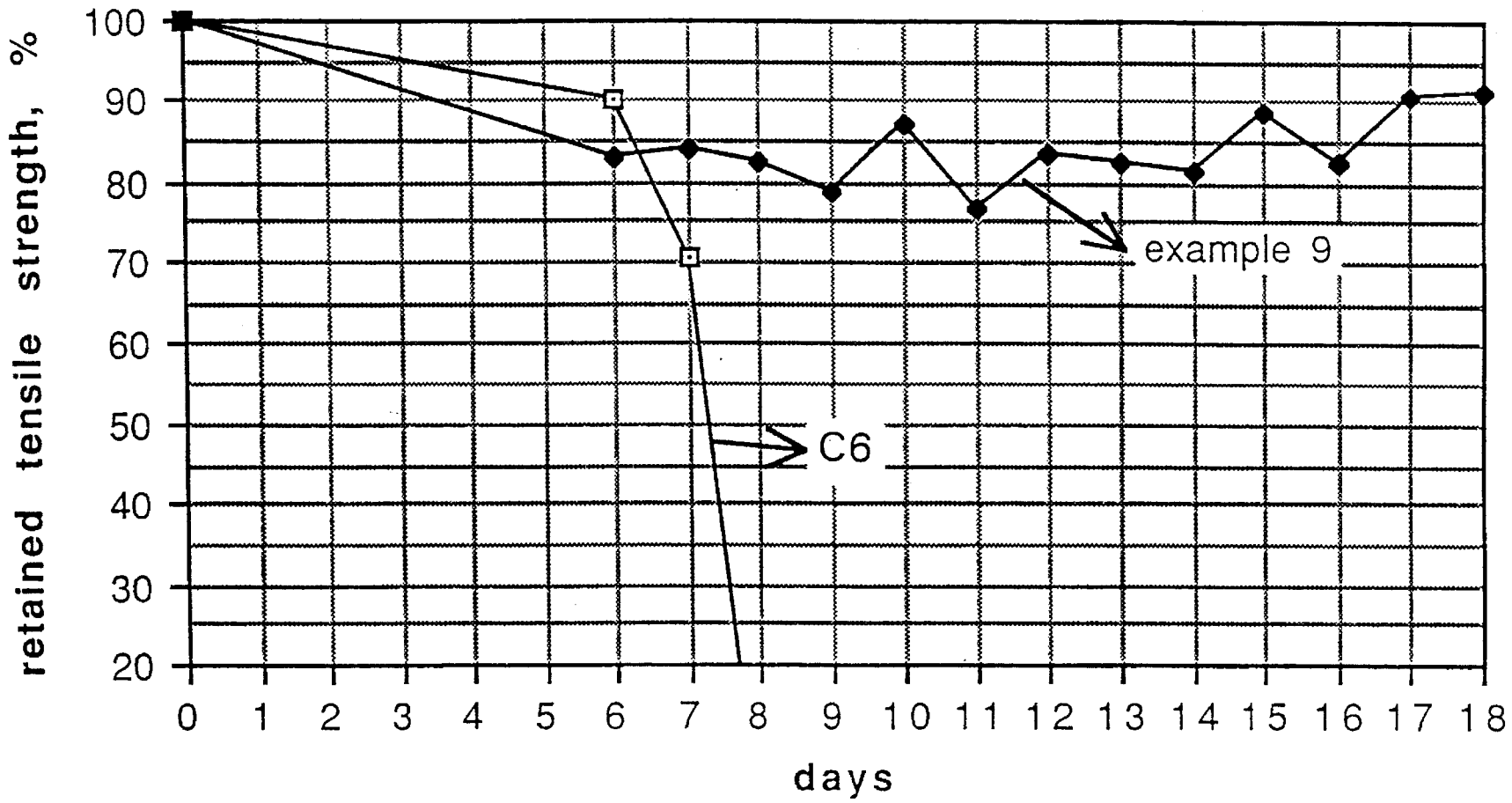
FIG. 4 is a graph of percent retained tensile strength of polyphthalamide monofilament and polyethylene terephthalate monofilament plotted against duration of exposure to 15 psi steam at 250° F.

Results of testing in 100° C. caustic solution are shown in FIG. 2. Again, retained tensile strengths of C2–C4 dropped rapidly and dramatically. Retained tensile strengths of Example 1 and C1 each dropped about 5% after 4 hours of treatment and then remained at about 95% for up to 96 hours.

Caustic resistance testing at 100° C. of the polyphthalamide of Example 1 and nylon 66 was repeated to validate previously obtained results. The validation test results, labelled "Ex. 2" and "C5", respectively, are shown in expanded scale in FIG. 3 with the replotted 100° C. test results of Example 1 and Comparative Sample C1. Retained tensile strength of nylon 66 remained unaffected for up to 48 hours of exposure, and trended downward thereafter. In contrast, retained tensile strengths of Examples 1 and 2 dropped to the 92–95% level after 4 hours and remained steady at this level for 96 hours of exposure.

TABLE 1

| Example | 1 |
|---|---|
| Diameter, mm | 0.5 |
| Denier | 2641 |
| Tenacity, g/denier | 4.26 |
| Elongation at break, % | 21.1 |
| Relative elongation at 3 g/denier, % | 12.2 |
| Elongation at 1 $lb_f$, % | 0.3 |
| Breaking energy, kg-mm | 381.1 |
| Breaking strength, $lb_f$ | 24.8 |
| Modulus, g/denier | 57.2 |
| Free shrink at 204° C., % | 11.3 |
| Abrasion resistance, cycles | 7945 |
| Accelerated hydrolysis resistance, % | 70 |
| Strength - loop, $lbs_f$ | 14.26 |
| Strength - knot, $lbs_f$ | 13.6 |

Examples 3 and 4

Amodel® AD-1002 was extruded in a single screw extruder and formed into a 0.6 mm diameter monofilament. Physical properties of two samples are shown in Table 2. Abrasion resistance of Example 4 was very good.

Examples 5 and 6

Amodel® AD-1002 was extruded at about 640° F. and formed into a 0.25 mm diameter monofilament. A 0.33 mm diameter monofilament was produced similarly. Physical properties of the 0.25 and 0.33 mm diameter monofilaments are shown in Table 2.

TABLE 2

| Example | 3 | 4 | 5 | 6 |
|---|---|---|---|---|
| Diameter, mm | 0.6 | 0.6 | 0.25 | 0.33 |
| Denier | 3238 | 3721 | 670 | 968 |
| Tenacity, g/denier | 4.09 | 3.98 | 5.11 | 4.76 |

TABLE 2-continued

| Example | 3 | 4 | 5 | 6 |
|---|---|---|---|---|
| Elongation at break, % | 17.1 | 17.3 | 20.5 | 23.1 |
| Relative elongation at 3 g/denier, % | 7.5 | 7.9 | 6.6 | 8.4 |
| Elongation at 1 $lb_f$, % | 0.15 | 0.13 | 0.98 | 0.77 |
| Breaking energy, kg/mm | 404.2 | 459.5 | 122.4 | 187.3 |
| Breaking strength$_f$, lb | 29.2 | 32.7 | 7.5 | 10.2 |
| Modulus, g/denier | 66.1 | 64.2 | 68.8 | 61.7 |
| Free shrink at 204° C., % | 15 | 15.3 | 11.1 | 10.5 |
| Abrasion resistance, cycles | — | 7200 | — | — |

Example 7

Amodel® A-1003 polyphthalamide resin was fed to a single screw extruder at a moisture content of 0.083 wt %. Although the moisture content was above the 0.07 wt % maximum recommended by the vendor, no adverse effects attributable to excess moisture were observed. The high compression ratio screw had a 24:1 length to diameter ratio and a high shear, modified Maddock type barrier flight mixing section. This screw configuration quite effectively melted the polymer pellets. Extruder melt temperature was as high as 635° F.

The melt was extruded through a multihole spinneret with holes of 2.75 mm capillary length, and 1.43 mm×2.71 mm cross-section dimensions. The monofilament was quenched in a water bath and then drawn in several stages to produce a 0.36 mm×0.62 mm cross-section monofilament. Only minor adjustments to the final heat setting oven temperature were necessary to obtain the desired free shrinkage of about 11%. Physical properties of two samples are presented in Table 3.

TABLE 3

| | Example 7 | |
|---|---|---|
| | SAMPLE A | SAMPLE B |
| Denier | 2067 | 2026 |
| Tenacity, g/denier | 4.85 | 4.67 |
| Elongation at break, % | 24.4 | 25.4 |
| Breaking strength, $lb_f$ | 22.1 | 20.9 |
| Relative elongation at 3 g/denier, % | 9.5 | 9.9 |
| Elongation at 1 $lb_f$, % | 0.39 | 0.37 |
| Breaking energy, kg-mm | 410.2 | 426.3 |
| Modulus, g/denier | 58.4 | 59.0 |
| Free shrink at 204° C., % | 11.2 | 11.0 |
| Abrasion resistance, cycles | — | 3785 |

Example 8 and Comparative Example C6

Amodel® A-1002 was extruded using a single screw extruder similar to that used in Example 7, at a melt temperature of 628° F. The polymer was extruded through a spinneret with holes of 2.75 mm capillary length and 0.86 mm×2.41 mm cross-section. The extrudate was drawn to an overall ratio of 3.24:1 to produce a 0.33 mm thick by 0.77 mm wide, flat monofilament.

For comparison a composition containing polyethylene terephthalate (PET) of 0.74 inherent viscosity and polycarbodiimide hydrolyric stabilizer was extruded in a single screw extruder. The screw configuration was of the type conventionally used for extrusion of PET. The extruder melt temperature was about 540° F. The melt was extruded through a spinneret with the same dimensions as in Example 8. The extrudate was drawn to an overall ratio of 4.40:1 to obtain a flat monofilament of nominal 0.3 mm thick×0.8 mm wide cross-section (Comparative Example C6).

Analytical test results for Example 8 and Comparative Example C6 monofilaments are presented in Table 4. Although the C6 monofilament had slightly higher tenacity, elongation at break and modulus than that of Example 8, the polyphthalamide monofilament exhibited much better abrasion resistance. The slightly lower accelerated hydrolysis result of Example 8 does not indicate the true performance of the disclosed monofilament because the accelerated test is a relatively imprecise measurement of hydrolysis resistance. Also, the C6 monofilament should perform better in the short-duration, accelerated test because it contained a hydrolytic stabilizer. The following example demonstrates that polyphthalamide monofilament according to this invention has better long term hydrolysis resistance than PET.

Example 9

Amodel® A-1002 resin was extruded using a single screw extruder equipped with a screw similar to that used in Comparative Example C6. The melt was extruded through spinneret holes of 4.0 mm capillary length, 2.0 mm diameter and the exturdate was drawn to an overall ratio of 3.7:1 to obtain a monofilament of 0.5 mm diameter. Physical properties of the monofilament are presented listed in Table 4.

Monofilaments of Example 9 and Comparative Example C6 were subjected to long term hydrolysis resistance testing according to the following procedure. Initially, breaking strengths were measured. Samples were treated by exposure to 15 psi pressure steam at 250° F. for up to 18 days. Samples were removed from the steam daily on the 6th through the 18th days and analyzed for breaking strength. Retained tensile strength, calculated as breaking strength after exposure to steam as a percentage of initial breaking strength was reported and is plotted in FIG. 4. The retained tensile strength of polyphthalamide remained at about for up to 18 days while that of the hydrolytically stabilized PET dropped precipitously after 6 days, confirming the superior long term hydrolysis resistance of polyphthalamide.

TABLE 4

| Example | 8 | C6 | 9 |
|---|---|---|---|
| Thickness, mm | 0.33 | 0.3 | — |
| Width, mm | 0.77 | 0.8 | — |
| Diameter | — | — | 0.5 |
| Tenacity, g/denier | 3.98 | 4.19 | 4.69 |
| Elongation at break, % | 29.5 | 32.7 | 18.9 |
| Relative elongation at 3 g/denier, % | 17.8 | 19.1 | 6.0 |
| Elongation at 1 $lb_f$, | 0.38 | 0.30 | 0.25 |
| Breaking energy, kg-mm | 458.1 | 598.9 | 353.6 |
| Breaking strength, $lb_f$ | 20.5 | 25.1 | — |
| Modulus, g/denier | 53.1 | 64.1 | 68.7 |
| Free shrink at 204° C., % | 5.3 | 5.9 | 13.8 |
| Abrasion resistance, cycles | 6788 | 4152 | — |
| Accelerated hydrolysis resistance, % | 73.6 | 89.2 | — |

Example 10

Amodel® AD-1003 polyphthalamide was extruded and formed into a warp yarn having a thickness of 0.38 mm and a width of 0.6 mm. The warp yarn and a 0.6 mm diameter filling yarn were woven into a 4 shed two-ply crow foot weave pattern fabric having 48 machine direction warp yarns per inch and 28 cross machine direction filling yarns per inch.

What is claimed is:

1. An improved industrial fabric formed of interconnected yarns wherein the improvement comprises at least some of the interconnected yarns being monofilament yarns consisting essentially of:

(A) about 65 to about 90 mole % of recurring units according to the formula

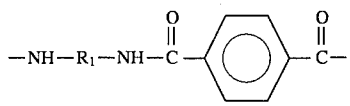

(B) about 0 to about 25 mole % of recurring units according to the formula

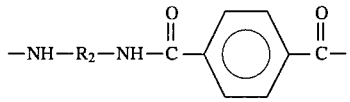

and, (C) about 5 to about 35 mole % of recurring units according to the formula

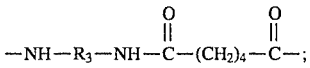

wherein the sum of (A)–(C) totals to 100 mole %; each of $R_1$, $R_2$ and R3 is independently a divalent aliphatic hydrocarbyl radical of 4–12 carbon atoms; and further provided, that the mole ratio of the dicarboxylic acid moieties in the units (B):(C) is less than 3:1.

2. A fabric as recited in claim 1 wherein recurring units of (A) are present from about 65 to about 80 mole %; recurring units of (B) are present from about 5 to about 25 mole %; and recurring units of (C) are present from about 10 to 15 mole %.

3. A fabric as recited in claim 2 wherein each of $R_1$, $R_2$ and $R_3$ is the $(CH_2)_6$ radical.

4. An improved process for making an industrial fabric by interconnecting yarns in a given arrangement, the improvement comprising the step of providing at least some interconnected yarns which are monofilaments of a polymer composition consisting essentially of:

(A) about 65 to about 90 mole % of recurring units according to the formula

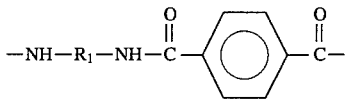

(B) about 0 to about 25 mole % of recurring units according to the formula

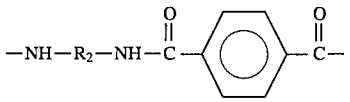

and, (C) about 5 to about 35 mole % of recurring units according to the formula $$-NH-R_3-NH-\overset{O}{\overset{\|}{C}}-(CH_2)_4-\overset{O}{\overset{\|}{C}}-;$$

wherein the sum of (A)–(C) totals to 100 mole %; each of $R_1$, $R_2$ and $R_3$ is independently a divalent aliphatic hydrocarbyl radical of 4–12 carbon atoms; and further provided, that the mole ratio of the dicarboxylic acid moieties in the units (B):(C) is less than 3:1.

5. The process of claim 4 wherein recurring units of (A) are present from about 65 to about 80 mole %; recurring units of (B) are present from about 5 to about 25 mole %; and recurring units of (C) are present from about 10 to 15 mole %.

6. The process of claim 5 wherein each of $R_1$, $R_2$ and $R_3$ is the $(CH_2)_6$ radical.

* * * * *

UNITED STATES PATENT AND TRADEMARK OFFICE

CERTIFICATE OF CORRECTION

PATENT NO. : 5,605,743

DATED : February 25, 1997

INVENTOR(S) : John R. Reither

It is certified that error appears in the above-indentified patent and that said Letters Patent is hereby corrected as shown below:

At column 2, line 14, "the sum of (A) -(C)$^{1}$" should read --the sum of (A) -(C)--.

Signed and Sealed this

Tenth Day of June, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,605,743

DATED : February 25, 1997

INVENTOR(S) : John R. Reither

It is certified that error appears in the above-indentified patent and that said Letters Patent is hereby corrected as shown below:

In column 2, in the space provided for numbered lines 1 to 5, delete

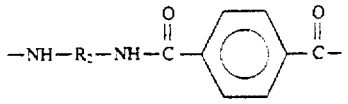

and insert therefor

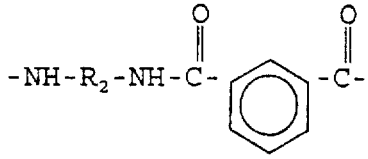

UNITED STATES PATENT AND TRADEMARK OFFICE

CERTIFICATE OF CORRECTION

PATENT NO. : 5,605,743

DATED : February 25, 1997

INVENTOR(S) : John R. Reither

It is certified that error appears in the above-indentified patent and that said Letters Patent is hereby corrected as shown below:

In column 8, claim 1, in the space provided for numbered lines 19 to 23, delete

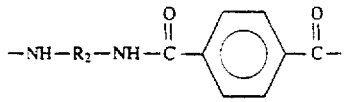

and insert therefor

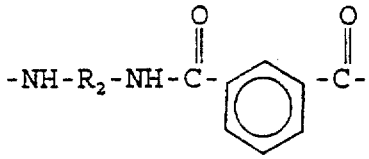

UNITED STATES PATENT AND TRADEMARK OFFICE

CERTIFICATE OF CORRECTION

PATENT NO. : 5,605,743

DATED : February 25, 1997

INVENTOR(S) : John R. Reither

It is certified that error appears in the above-indentified patent and that said Letters Patent is hereby corrected as shown below:

In column 8, claim 4, in the space provided for numbered lines 59 to 64, delete

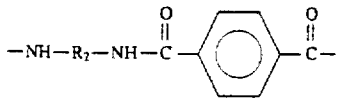

and insert therefor

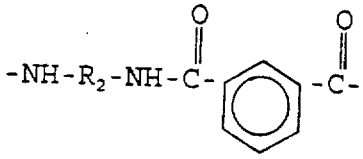

Signed and Sealed this

Eleventh Day of November, 1997

*Attest:*

BRUCE LEHMAN

*Attesting Officer*

*Commissioner of Patents and Trademarks*